US007875167B2

(12) United States Patent
Brignac et al.

(10) Patent No.: US 7,875,167 B2
(45) Date of Patent: Jan. 25, 2011

(54) LOW PRESSURE SELECTIVE DESULFURIZATION OF NAPHTHAS

(75) Inventors: Garland Brignac, Clinton, LA (US); Thomas R. Halbert, Baton Rouge, LA (US); John P. Greeley, Fairfax, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 229 days.

(21) Appl. No.: 12/006,160

(22) Filed: Dec. 31, 2007

(65) Prior Publication Data

US 2009/0166263 A1 Jul. 2, 2009

(51) Int. Cl.
*C10G 45/08* (2006.01)
*C10G 45/06* (2006.01)

(52) U.S. Cl. ..... 208/216 R; 208/208 R; 208/209; 208/213; 208/217; 208/243; 208/244; 208/264; 208/295

(58) Field of Classification Search ..... 208/216 R
See application file for complete search history.

(56) References Cited

U.S. PATENT DOCUMENTS

| | | | | |
|---|---|---|---|---|
| 5,985,136 | A | 11/1999 | Brignac | |
| 6,013,598 | A | 1/2000 | Lapinski | |
| 6,126,814 | A | 10/2000 | Lapinski | |
| 6,231,753 | B1 | 5/2001 | McKnight | |
| 6,409,913 | B1 | 6/2002 | Clark | |
| 6,913,688 | B2 | 7/2005 | Coker | |
| 7,220,352 | B2 | 5/2007 | Halbert | |
| 2001/0020596 | A1 * | 9/2001 | Jossens et al. | 208/216 R |
| 2005/0098479 | A1 * | 5/2005 | Jacobs et al. | 208/216 R |

OTHER PUBLICATIONS

"Structure and Properties of Molybdenum Sulfide: Correlation of O2 Chemisorption with Hydroesulfurization Activity", Journal of Catalysis, vol. 63, pp. 515-519 (1980).

* cited by examiner

*Primary Examiner*—Glenn A Caldarola
*Assistant Examiner*—Michelle L Stein

(57) ABSTRACT

A low hydrogen partial pressure process for desulfurizing naphtha in the presence of a hydrodesulfurization catalyst which catalyst is selective for suppressing hydrogenation of olefins and in the presence. This invention also relates to the use of optimum metals loading for achieving a high level of hydrodesulfurization with a low level of olefin saturation.

12 Claims, 3 Drawing Sheets

LOW PRESSURE SELECTIVE DESULFURIZATION OF NAPHTHAS

CROSS REFERENCE TO RELATED APPLICATIONS

Not Applicable

FIELD OF THE INVENTION

This invention relates to a low hydrogen partial pressure process for desulfurizing naphtha in the presence of a hydrodesulfurization catalyst which catalyst is selective for suppressing hydrogenation of olefins. This invention also relates to the use of optimum metals loading for achieving a high level of hydrodesulfurization with a low level of olefin saturation.

BACKGROUND OF THE INVENTION

Low sulfur motor gasoline (mogas) requires the production of low sulfur blend stocks for the mogas pool. The primary blend stocks are derived from cat cracked (e.g., FCC) naphthas, which in addition to unwanted organic sulfur compounds, are rich in olefins desirable for meeting high octane rating requirements. The naphtha is reacted with hydrogen in the presence of a sulfided hydrodesulfurization (HDS) catalyst, which results in the formation of $H_2S$ and a sulfur-reduced naphtha. The $H_2S$ is separated from the sulfur-reduced naphtha, which naphtha is then used for mogas. HDS catalysts are known and typically contain a catalytic component of at least one Group VIB metal, and more often a mixture of non-noble Group VIII and Group VIB metals. In addition to having catalytic activity for removing sulfur and other heteroatoms, these naphtha hydrodesulfurization catalysts have hydrogenation activity, which saturates desirable olefins.

Conventional fixed bed hydrodesulfurization can reduce the sulfur level of cracked naphthas to very low levels; however, it typically also results in undesirable octane loss because of excessive hydrogenation of olefins. Further, $H_2S$ produced during conventional hydrodesulfurization, reacts with olefins in the feed to form mercaptans, which are known as reversion mercaptans. A process, referred as SCANfining, has been developed which employs a proprietary catalyst that avoids the undesirable degree of octane loss through olefin saturation. Such a process and catalysts are taught in U.S. Pat. Nos. 6,013,598; 6,231,753; 6,913,688 and 7,220,352.

SUMMARY OF THE INVENTION

In a preferred embodiment there is provided a process for hydrodesulfurizing a naphtha feedstock containing both sulfur and olefins while inhibiting mercaptans formation. The process includes hydrodesulfurizing the naphtha feedstock in a reaction zone. The feedstock has a boiling range from about 65° F. to about 430° F., contains less than about 500 wppm sulfur, and contains at least about 5 wt. % olefins, based on the total weight of the feedstock. The reaction zone contains an effective amount of a hydrogen-containing treat gas. The reaction zone also contains an effective amount of a hydrodesulfurization catalyst comprised of at least one Group VIII non-noble metal and at least one Group VI metal on a refractory support. The reaction zone is operated at temperatures from about 450° F. to about 700° F., a hydrogen partial pressure of about 50 to about 100 psig, and hydrogen treat gas rate of about 200 to about 5000 scf/b.

In other preferred embodiments the hydrogen partial pressure is from about 50 to 75 psig and the treat gas rate is from about 400 to about 2000 scf/b.

DETAILED DESCRIPTION OF THE INVENTION

Figure 1:
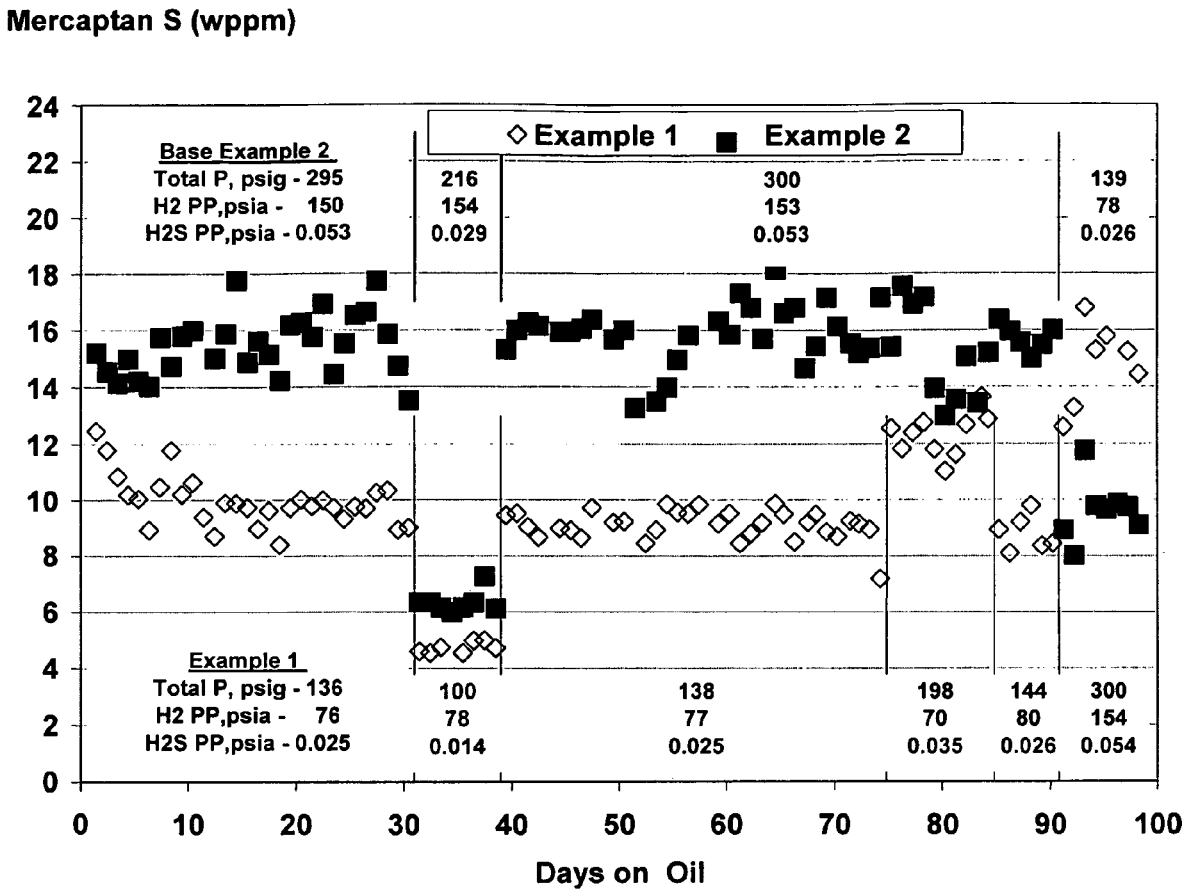
FIG. 1 shows mercaptan sulfur levels of naphtha feeds processed under various conditions.

Naphtha feedstocks suitable for use in the present invention can comprise any one or more refinery streams boiling in the range from about 50° F. to about 450° F., at atmospheric pressure. The naphtha feedstock generally contains cracked naphtha which usually comprises fluid catalytic cracking unit naphtha (FCC catalytic naphtha), coker naphtha, hydrocracker naphtha, resid hydrotreater naphtha, and gasoline blending components from other sources wherein a naphtha boiling range stream can be produced. FCC catalytic naphtha and coker naphtha are generally more olefinic naphthas since they are products of catalytic and/or thermal cracking reactions, and are the more preferred streams for use in the present invention.

The naphtha feedstock, preferably a cracked naphtha feedstock, generally contains not only paraffins, naphthenes, and aromatics, but also unsaturates, such as open-chain and cyclic olefins, dienes, and cyclic hydrocarbons with olefinic side chains. The cracked naphtha feedstock generally comprises an overall olefins concentration ranging as high as about 60 wt. %, more typically as high as about 50 wt. %, and most typically from about 5 wt. % to about 40 wt. %. The cracked naphtha feedstock can comprise a diene concentration of as much as about 15 wt. %, but more typically ranges from about 0.1 wt. % to about 5 wt. % of the feedstock. High diene concentrations can result in a gasoline product having poor stability and color. The sulfur content of cracked naphtha feedstock will generally range from about 0.05 wt. % to about 0.7 wt. % and more typically from about 0.1 wt. % to about 0.5 wt. % based on the total weight of the feedstock. Nitrogen content will generally range from about 5 wppm to about 500 wppm, and more typically from about 20 wppm to about 200 wppm.

The selective hydrodesulfurization process of the present invention removes organic sulfur compounds, including mercaptan and non-mercaptan sulfur compounds from a naphtha feed, with reduced formation of reversion mercaptans, by conducting the hydrodesulfurization reaction within the specific process constraints of high temperature, low pressure and relatively high hydrogen treat gas rates. While the value for any one of these three hydrodesulfurization process constraints (temperature, pressure and hydrogen treat gas rates) used in the process of the invention may fall within the extremely broad windows of hydrodesulfurization process conditions that one might piece together from a multiplicity of various disclosures, the combination thereof and the unexpected and unique results obtained, have not heretofore been known in the art to be used for naphtha hydroprocessing. It has been found by the inventors hereof that these three specific operating constraints improve the hydrodesulfurization selectivity, by favoring hydrodesulfurization with less olefin saturation (octane loss). At these selective hydrodesulfurization conditions of high temperature, low pressure and high treat gas rates, the high concentration of $H_2S$ formed in the hydrodesulfurization reactor, resulting from the deep desulfurization, along with high concentrations of retained feed olefins, would be expected to inherently promote mercaptan reversion. Surprisingly, the opposite has been observed. It has unexpectedly been found that, at a given level of retained feed olefins and $H_2S$ formed by the hydrodesulfurization (as found in the effluent of the hydrodesulfurization reactor), significantly less mercaptans are formed by reversion using the process constraints of the present invention, than that which occurs at conditions of temperature, pressure and treat gas ratio outside the ranges of the present invention. Such conditions outside the constraints of the present invention are typically one or more of: lower temperature; higher pressure; and low treat gas rates. The combination of deep desulfurization of the naphtha feed, along with the relatively high olefin retention and reduced mercaptan formation, achieved with the process of the invention, is therefore unexpected. The Table below illustrates the broad and narrow ranges of temperature, pressure and treat gas ratio of the present invention, in comparison with typical prior art ranges.

Selective Hydrodesulfurization Conditions

| Conditions | Broad | Narrow | Most Preferred |
|---|---|---|---|
| Temp. ° F. | 450-700 | 500-650 | |
| $H_2$ Part. Press., psig | 50-125 | 50-100 | 50-75 |
| Treat Gas Rate, scf/b | 200-5000 | 400-2000 | |

It is anticipated that environmentally driven regulatory pressure on motor gasoline (mogas) sulfur levels, will result in the widespread production of 30 ppm or lower total sulfur mogas. Further, gas oil and other feeds for a fluid cat cracker used to produce cat cracked naphthas, are increasingly using ever more amounts of poorer quality, high sulfur content streams, due to the dwindling supply of high quality crude oil. This results in a higher sulfur content in the resulting cat cracked naphthas, which are the major source of naphtha stocks for mogas pools. Thus, the reduction in mercaptan reversion achieved by the selective hydrodesulfurizing process of the present invention is important with respect to the desulfurized product meeting both low total sulfur and mercaptan sulfur specifications, while preserving the olefins which are valuable for octane. At such deep levels of desulfurization of from 90-100 wt. % sulfur removal, particularly with relatively high sulfur content naphtha feeds (e.g., >500 wppm and particularly feeds having 1500-7000 wppm sulfur), the contribution of the sulfur from reversion mercaptans, to the total sulfur, can be significant. Therefore, the control of mercaptan formation is necessary to reach these very low sulfur levels.

Organic sulfur compounds in a typical naphtha feed to be desulfurized, include mercaptan sulfur compounds (RSH), sulfides (RSR), disulfides (RSSR), thiophenes and other cyclic sulfur compounds, and aromatic single and condensed ring compounds. Mercaptans present in the naphtha feed typically have from one to three ($C_1$-$C_3$) carbon atoms. During the hydrodesulfurization process, the feed mercaptans are removed by reacting with hydrogen, in the presence of one or more hydrodesulfurization catalysts, and forming $H_2S$ and paraffins. It is believed that the $H_2S$ produced in the reactor from the removal of organic sulfur compounds, reacts with the olefins to form new mercaptans (reversion mercaptans). Generally it has been found that the mercaptans present in the hydrodesulfurized product have a higher carbon number, than those found in the feed. These reversion mercaptans formed in the reactor, and which are present in the desulfurized product, typically comprise $C_4$+ mercaptans. It has been proposed in the art to reduce the mercaptan and/or total sulfur of the hydrodesulfurized naphtha product by means such as: 1) pretreating the feed to saturate diolefins, 2) extractive sweetening of the hydrotreated product, and 3) product sweetening with an oxidant, alkaline base and catalyst. However, diolefin saturation requires an additional reactor vessel and has not been demonstrated as effective for reducing RSH formation. The higher carbon number mercaptans produced by the reversion reactions are difficult to extract into caustic. The third approach suggests sweetening the product by producing disulfides from the mercaptans, and therefore has no value in reducing the total sulfur, as does the process of the invention.

Hydrodesulfurization catalysts typically contain at least one Group VIII non-noble metal, preferably Co and at least one Group VI metal, preferably Mo. There are many hydrodesulfurization catalysts in the prior art that are similar to those of the instant invention, but none can be characterized as having all of the unique properties, and thus the level of activity for hydrodesulfurization in combination with the relatively low olefin saturation, as those preferred by the present invention. For example, some conventional hydrodesulfurization catalysts typically contain $MoO_3$ and CoO levels within the range of those instantly claimed. Other hydrodesulfurization catalysts have surface areas and pore diameters in the range of the instant catalysts. Only when all of the properties of the instant catalysts are present can such a high degree of hydrodesulfurization in combination with such low olefin saturation be met. The properties which are critical to the catalysts of the present invention include: (a) a $MoO_3$ concentration of about 4 to 8 wt. %, preferably about 4.5 to 8 wt. %, and more preferably about 6.2 to 6.6 wt. %, based on the total weight of the catalyst; (b) a CoO concentration of about 0.1 to 5 wt. %, preferably about 2 to 2.5 wt. %, and more preferably about 2.2 wt. %, also based on the total weight of the catalyst; (c) a Co/Mo atomic ratio of about 0.1 to about 1.0, preferably from about 0.4 to about 0.80; (d) a median pore diameter of about 60 Angstroms to about 200 Angstroms, preferably from about 75 Angstroms to about 175 Angstroms, and more preferably from about 80 Angstroms to about 150 Angstroms; (e) a $MoO_3$ surface concentration of about $0.5\times10^{-4}$ to about $3\times10^{-4}$ g. $MoO_3/m^2$, preferably about $0.75\times10^{-4}$ to about $2.5\times10^{-4}$, more preferably from about $1.5\times10^{-4}$ to about $2.5\times10^{-4}$; and (f) an average particle size diameter of less than 2.0 mm, preferably less than about 1.6 mm, more preferably less than about 1.4 mm, and most preferably as small as practical for a commercial hydrodesulfurization process unit.

It has also been unexpectedly found that selectivity can be maintained with increasing metals loading and hydrodesulfurization activity, up to a specific point beyond which selectivity begins to fall. This makes it possible to better optimize the loading of metals for both activity and selectivity. This preferred range, based on CoO, is from about 2.1 to about 2.3 wt. %, more preferably about 2.2 wt. % CoO. The most preferred catalysts will also have a high degree of metal sulfide edge plane area as measured by the Oxygen Chemisorption Test described in "Structure and Properties of Molybdenum Sulfide Correlation of $O_2$ Chemisorption with Hydrodesulfurization Activity", S. J. Tauster et al., *Journal of Catalysis* 63, pp 515-519 (1980). The Oxygen Chemisorption Test involves edge-plane area measurements made wherein pulses of oxygen are added to a carrier gas stream and thus rapidly traverse the catalyst bed. For example, the oxygen chemisorption will be from about 800 to 4000, preferably from about 2,000 to 4000, and more preferably from about 2500 to 3000 μmol oxygen/gram $MoO_3$. The terms hydrotreating and hydrodesulfurization are sometimes used interchangeably in this document.

The catalysts of the present invention are supported catalysts. Any suitable inorganic oxide support material can be used for the catalyst of the present invention. Non-limiting examples of suitable support materials include: alumina, silica, titania, calcium oxide, magnesium oxide, strontium oxide, barium oxide, carbons, zirconia, diatomaceous earth, lanthanide oxides including cerium oxide, lanthanum oxide, neodymium oxide, yttrium oxide, and praseodymium oxide; chromia, thorium oxide, urania, niobia, tantala, tin oxide, zinc oxide, and aluminum phosphate. Preferred are alumina, silica, and silica-alumina. More preferred is alumina. For the high metals dispersion catalysts of the invention, magnesia can also be used. It is to be understood that the support material can contain small amount of contaminants, such as Fe, sulfates, silica, and various metal oxides that can be present during the preparation of the support material. These contaminants are present in the raw materials used to prepare the support and will preferably be present in amounts less than about 1 wt. %, based on the total weight of the support. It is more preferred that the support material be substantially free of such contaminants. In an alternative embodiment, about 0 to 5 wt. %, preferably from about 0.5 to 4 wt. %, and more preferably from about 1 to 3 wt. %, of an additive can be optionally present in the support, which additive is selected from the group consisting of potassium and metals or metal oxides from Group IA (alkali metals) of the Periodic Table of the Elements.

This invention is better understood with reference to the following non-limiting examples.

EXAMPLE 1 AND EXAMPLE 2

The catalyst used for both of these two examples was RT-225, a $CoMo/Al_2O_3$ catalyst. The reactor used for each example was a fixed bed, isothermal downflow, pilot plant tubular reactor. The catalyst contained 1.2 wt. % CoO and 4.5 wt. % $MoO_3$ in 1.3 mm ASQ form. Before loading, the catalyst samples were dried for 3 hours at 750° F. to enable the measuring of catalyst charges by weight on a water-free basis. A total of 30 cubic centimeters of catalyst was loaded in each reactor. After loading, the catalysts were treated with nitrogen at 700° F. for 6 hours. The reactors were then cooled to 200° F. and catalyst activation was started. Activation was achieved using a 10 mole % $H_2S/H_2$ gas blend in virgin naphtha, for approximately 14 hours at two holding temperatures, 400° F. (gas/liquid mixed phase) and 650° F. (all vapor phase), and with a reactor pressure of 300 psig. The reactors were then cooled to 200° F. before the introduction of the naphtha feed to be desulfurized. A full range cat naphtha feed was introduced into each reactor for catalyst break-in and performance testing. Feed sulfur for the full range cat naphtha was 122.7 wppm and had a bromine number of 66.2 cg/g.

This set of examples was designed to compare the stability and performance of the reactors. Initially, the reactor for Example 1 was operated at 75 psia $H_2$ partial pressure while the reactor for Example 2 was operated at the typical 150 psia $H_2$ partial pressure. Based on these initial settings, Example 1 corresponds to operation according to the invention while Example 2 is a comparative example. Each reactor was operated in a modified TIR (Temperature Increase Required) mode for approximately 90 days. TIR operation involves gradual increase in temperature of a reactor as required to maintain a target sulfur level in a product at constant feed rate (LHSV), pressure, and treat gas ratio. This corresponds to a type of operating mode that is commonly used in a commercial setting.

Starting conditions for both reactors were 535° F., 1000 SCF/B treat gas ratio (100% hydrogen), and 5.0 liquid hourly space velocity. The reactor for Example 1 was operated at 140 psig (75 psia $H_2$ partial pressure) while Example 2 was operated at 300 psig (150 psia $H_2PP$).

The olefin concentration (bromine number) remained relatively constant over the course of both reactor runs, and temperatures were increased only modestly (about 10° F.). Changes in the $H_2S$ partial pressure, therefore, would be expected to be the main factor affecting the equilibrium level of mercaptan sulfur in the product. During the low pressure run (Example 1) at 140 psig total pressure and 75 psia $H_2$ partial pressure with 100% hydrogen treat gas, the average level of mercaptan sulfur was about 9 wppm (data from 40 to 74 days on oil) and the $H_2S$ partial pressure averaged 0.025 psia. By contrast, the high pressure run (Example 2) averaged about 16 wppm mercaptan sulfur at a $H_2S$ partial pressure of 0.053 psia. The reactor for Example 1 was used to further investigate the impact of $H_2$ partial pressure versus total pressure during day 75 through 84 of the reactor run. In this time window, the treat gas was changed to 70% purity hydrogen and the total pressure was increased to approximately 200 psig in order to maintain the $H_2$ partial pressure at about 75 psia. At these conditions the $H_2S$ partial pressure was increased from 0.025 psia to 0.035 psia and the average mercaptan sulfur in the product increased from about 9 wppm to about 12 wppm. FIG. 1 shows product mercaptan sulfur for Examples 1 and 2 runs versus days on oil.

The pressure was switched for both reactors for the last eight balances of each run (91 through 98 days on oil). Total pressure was increased in the reactor used for Example 1 to 300 psig and decreased in reactor used for Example 2 to 140 psig. Correspondingly, the $H_2$ partial pressure in Example 1 increased from about 75 psia to 150 psia while the $H_2$ partial pressure decreased from 150 psia to 75 psia for Example 2. As a result, during days 91 to 98, the reactor for Example 2 was operated in accordance with the invention. Example 1 represents a comparative example during this time period. The last eight points in FIG. 1 hereof show this data. As can be seen in FIG. 1, the level of mercaptan sulfur in the product increased in Example 1 when the total pressure increased and $H_2S$ partial pressure increased to 0.054 psia. Likewise, the level of mercaptan sulfur in the product from Example 2 decreased after the total pressure was lowered and $H_2S$ partial pressure was lowered to 0.026 psia. Both levels of mercaptan sulfur were controlled by equilibrium corresponding to the level of $H_2S$.

Low pressure operating conditions of 140 psig total pressure and 75 psia $H_2$ partial pressure with 100% hydrogen treat gas resulted in very little olefin saturation. This was observed for the initial 90 days in the reactor for Example 1 and also in the reactor for Example 2 when conditions were adjusted to low pressure from day 91 through 98. Low pressure not only reduced reversion mercaptan equilibrium levels, but also reduced the olefin saturation rate and increased the HDS rate. Selectivity with 70% hydrogen purity treat gas and 200 psig total pressure (75 psia $H_2$ partial pressure), was less than that observed with 100% hydrogen treat gas at 140 psig total pressure (75 psia $H_2$ partial pressure). With the lower purity gas and higher total pressure, the $H_2S$ partial pressure is relatively high, leading to mercaptan reversion levels comparable to those observed with the 150 psi $H_2$ partial pressure run with 100% hydrogen. Clearly, optimum overall selectivity lies with both low $H_2$ partial pressure and low total pressure.

Figure 2:
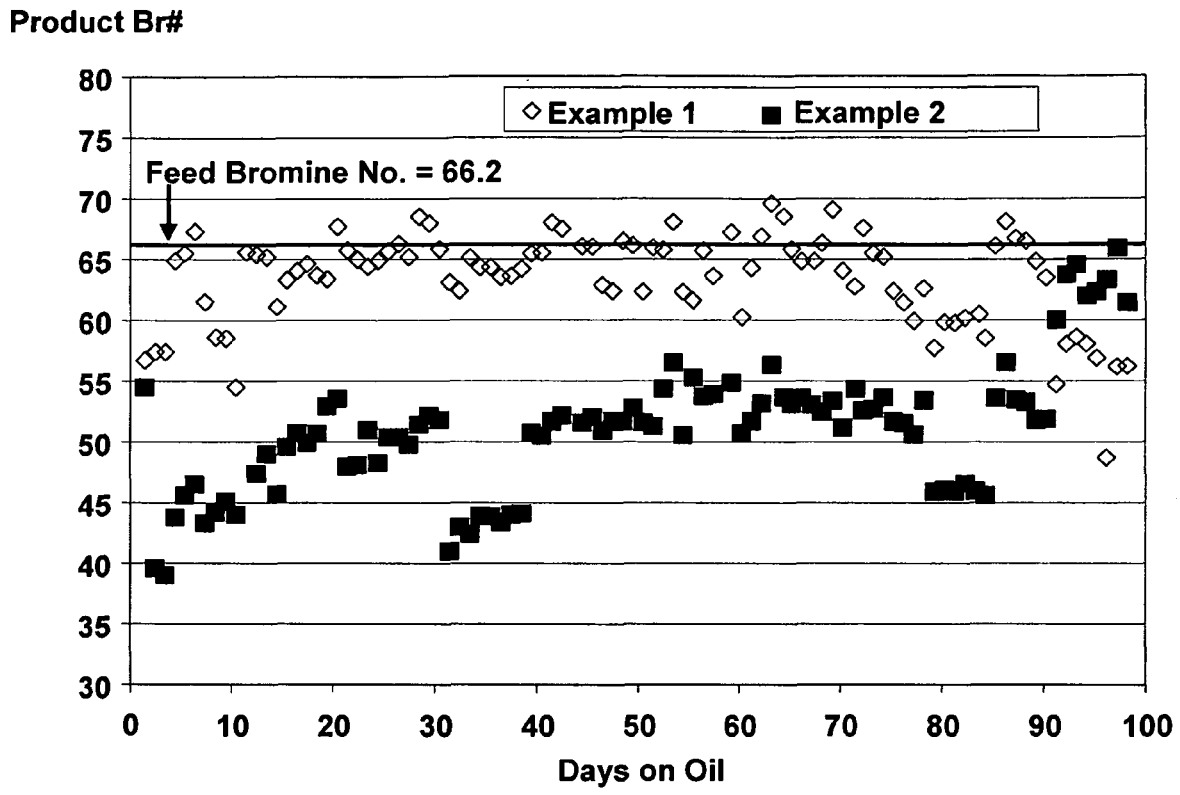
FIG. 2 shows the bromine number for naphtha feeds processed under various conditions.
Figure 3:
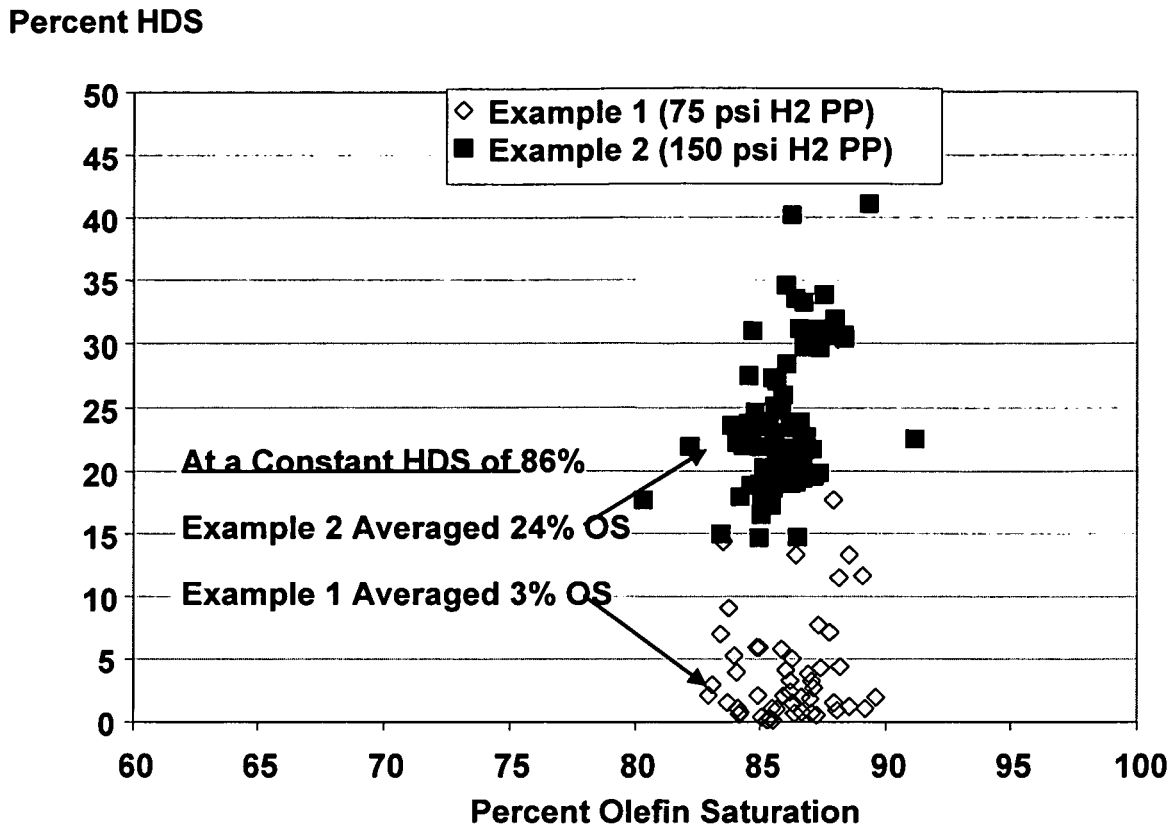
FIG. 3 shows a comparison of the percentage hydrodesulfurization versus percentage olefin saturation for naphtha feeds processed under various conditions.

FIG. 2 gives bromine number results for product samples from the low pressure and standard pressure runs versus days on oil. In the figure, bromine number results from Example 1 at low pressure are similar to or only slightly lower than the feed bromine number. The feed bromine number was 66.2. On average, lined out data from Example 1 at low pressure gave about a 65 product bromine number. From approximately day 91 through day 98, pressure was lowered in the run in the reactor for Example 2 to 140 psig total pressure and 75 psia $H_2$ partial pressure. At this pressure, very little olefin saturation occurred, consistent with the observations from Example 1 for the first 90 days. The product bromine number for these balances averaged 63. During the same period (day 91-98), pressure was increased in the reactor for Example 1 to 300 psig total pressure and 150 psia $H_2$ partial pressure, resulting in greater olefin saturation. Product bromine number from the high pressure balances (days 91 to 98) in Example 1 averaged about 57. The bromine number for Example 2 at high pressure conditions (days 1 to 90) averaged about 52. Table 1 below shows olefin saturation at a constant percent HDS of 85.5%. The table includes measured olefin saturation at 150 psia $H_2$ partial pressure and measured and predicted at 75 psia $H_2$ partial pressure. Model predictions, based on a kinetic model developed from an extensive pilot plant database at hydrogen partial pressures of about 150 to about 250 psia, estimated the effect of lowering pressure to be much less than actually measured. A selectivity plot is shown in FIG. 3 hereof.

TABLE 1

| | Olefin Saturation at 85.5% HDS |
|---|---|
| Conventional 150 psia $H_2$ Partial Pressure (PP) | 26.4 |
| Predicted Low Pressure - 75 psia $H_2$ PP | 15.0 |
| Actual Low Pressure - 75 psia $H_2$ PP | 4.5 |

COMPARATIVE EXAMPLES A AND B

A batch of RT-225 CoMo on alumina catalyst was loaded in each of two reactors. The catalysts were sulfided using a mixture of $H_2S$ in hydrogen and virgin naphtha, at a series of increasing temperatures up to 650° F. A standard Intermediate Cat Naphtha feed was introduced into the reactor to measure catalyst HDS activity and HDS/olefin saturation (OS) selectivity. The intermediate cat naphtha feed had about (on average) 1629 wppm sulfur and about a 62.3 bromine number.

COMPARATIVE EXAMPLE C AND EXAMPLE 3

Two additional pilot plant runs were also performed, but with higher metals loaded CoMo on alumina catalysts. One in reactor contained a catalyst comprised of 2.2 wt % CoO and 6.6 wt % $MoO_3$ on alumina (Example 3) while the other reactor was loaded with a catalyst comprised of 2.67 wt % CoO and 8.0 wt % $MoO_3$ on alumina (Comparative Example C). A total of 20 cubic centimeters of each catalyst was loaded in each of the reactors. As for comparative Examples A and B, the catalysts were sulfided using a mixture of $H_2S$ in hydrogen and virgin naphtha, at a series of increasing temperatures up to 650° F. A standard Intermediate Cat Naphtha feed was introduced into the reactor to measure catalyst HDS activity and HDS/olefin saturation (OS) selectivity. The intermediate cat naphtha feed had about (on average) 1629 wppm sulfur and about a 62.3 bromine number.

The HDS relative catalytic activity (RCA) and HDS/OS selectivity of the catalysts from Comparative Examples A and B were averaged. The averaged values were compared with the results generated for Comparative Example C and Example 3. Standard test conditions were 525° F., 230 psig, and 2000 scf/b treat gas ratio (100% hydrogen). Liquid hourly space velocity was varied to cover a range of HDS conversions.

These examples demonstrate that there is an optimum loading concentration of Co (and Mo) which results in an increase in HDS activity and at the same time maintains the HDS/OS selectivity of catalysts in selective cat naphtha desulfurization service. Results are shown in Table 2 below. Data shown are based on CoO loading; the same trends appear as a function of Mo loading. As can be seen in Table 2, increasing the CoO loading from 1.2 wt % (Comparative Examples A and B) to 2.2 wt % (Example 3) to 2.7 wt % (Comparative Example C) resulted in an increase in HDS activity. However, over the same range of CoO loading, the effect on HDS/OS selectivity was different. An optimum was observed in which HDS activity increased with no loss in selectivity. HDS/OS selectivity (selectivity factor) for CoO loadings of 1.2 wt % and 2.2 wt % was the same at 1.2. However, when the CoO loading was increased from 2.2 wt % to 2.67 wt % (Comparative Example C), a significant drop in the HDS/OS selectivity factor was observed down to 0.9. An optimum metals loading was found at roughly 2.2 wt % CoO.

TABLE 2

| | Examples A and B (averaged, Comparative) | Example 3 | Example C (Comparative) |
|---|---|---|---|
| Selectivity Factor (HDS/OS) | 1.2 | 1.2 | 0.9 |
| HDS RCA | 122 | 202 | 266 |

What is claimed is:

1. A process for hydrodesulfurizing a naphtha feedstock containing both sulfur and olefins while inhibiting mercaptans formation, comprising:

hydrodesulfurizing said naphtha feedstock in a reaction zone, the feedstock having a boiling range from about 65° F. to about 430° F. and containing less than about 500 wppm sulfur and at least about 5 wt. % olefins, based on the total weight of the feedstock, the reaction zone containing an effective amount of a hydrogen-containing treat gas and an effective amount of a hydrodesulfurization catalyst comprised of from about 2.1 to about 2.3 wt. % cobalt, based on CoO, and at least one Group VI metal on a refractory support, wherein the reaction zone is operated at temperatures from about 500° F. to about 650° F., a hydrogen partial pressure of about 50 to about 100 psig, and hydrogen treat gas rate of about 400 to about 2000 scf/b.

2. The process of claim 1 wherein the naphtha is a cat cracked naphtha.

3. The process of claim 2 wherein the hydrogen partial pressure is from about 50 to 75 psig.

4. The process of claim 1 wherein only one Group VIII non-noble metal is present which is Co.

5. The process of claim 1 wherein only one Group VI metal is present which is Mo.

6. The process of claim 3 wherein the catalyst is comprised of Co and Mo on a refractory support.

7. The process of claim 1 wherein the catalyst is comprised of about 1 to 10 wt. % molybdenum, based on $MoO_3$.

8. The process of claim 6 wherein the catalyst is comprised of about 1 to 10 wt. % molybdenum, based on $MoO_3$.

9. The process of claim 7 wherein the catalyst exhibits a Co/Mo atomic ratio of about 0.1 to 1.0.

10. The process of claim 9 wherein the catalyst has a median pore diameter of about 60 Å to 200 Å.

11. The process of claim 1 wherein the catalyst is comprised of about 4 to 8 wt. % molybdenum, based on $MoO_3$.

12. The process of claim 6 wherein the catalyst is comprised of about 4 to 8 wt. % molybdenum, based on $MoO_3$.

* * * * *